US009784437B2

(12) United States Patent
Riaby et al.

(10) Patent No.: US 9,784,437 B2
(45) Date of Patent: Oct. 10, 2017

(54) ADJUSTABLE LIGHT MECHANISM FOR A MERCHANDISER

(71) Applicant: Hussmann Corporation, Bridgeton, MO (US)

(72) Inventors: Jafary H. Riaby, Anaheim Hills, CA (US); Robert Mullen, Anaheim, CA (US)

(73) Assignee: Hussmann Corporation, Bridgeton, MO (US)

( * ) Notice: Subject to any disclaimer, the term of this patent is extended or adjusted under 35 U.S.C. 154(b) by 241 days.

(21) Appl. No.: 14/622,562

(22) Filed: Feb. 13, 2015

(65) Prior Publication Data

US 2015/0233549 A1 Aug. 20, 2015

Related U.S. Application Data

(60) Provisional application No. 61/940,230, filed on Feb. 14, 2014.

(51) Int. Cl.

| | |
|---|---|
| ***F21V 14/02*** | (2006.01) |
| ***F21V 33/00*** | (2006.01) |
| ***F21V 19/00*** | (2006.01) |
| ***A47F 11/10*** | (2006.01) |
| ***F21V 21/34*** | (2006.01) |
| *F21W 131/405* | (2006.01) |
| *F21W 131/305* | (2006.01) |

(Continued)

(52) U.S. Cl.

CPC ..... *F21V 14/02* (2013.01); *A47F 11/10* (2013.01); *F21V 19/002* (2013.01); *F21V 21/34* (2013.01); *F21V 33/006* (2013.01); *F21W 2131/305* (2013.01); *F21W 2131/405* (2013.01); *F21Y 2103/10* (2016.08); *F21Y 2115/10* (2016.08)

(58) Field of Classification Search

CPC ..... F21V 14/02; F21V 19/002; F21V 21/34; F21V 33/006; A47F 11/10; F21Y 2103/10; F21Y 2115/10; F21W 2131/305; F21W 2131/405

See application file for complete search history.

(56) References Cited

U.S. PATENT DOCUMENTS

| | | | |
|---|---|---|---|
| 5,040,101 | A | 8/1991 | Aspenwall |
| 5,816,171 | A | 10/1998 | Fitts, Jr. |
| 6,131,866 | A | 10/2000 | Kesinger |

(Continued)

FOREIGN PATENT DOCUMENTS

| | | |
|---|---|---|
| CA | 2641476 | 5/2009 |
| CA | 2803000 | 12/2011 |

(Continued)

OTHER PUBLICATIONS

International Search Report from the International Searching Authority for Application No. PCT/2015/016015 dated May 22, 2015 (5 pages).

(Continued)

*Primary Examiner* — Mary Ellen Bowman
(74) *Attorney, Agent, or Firm* — Michael Best & Friedrich LLP

(57) ABSTRACT

A merchandiser including a case that defines a product display area and a luminaire that is coupled to the case to illuminate at least a portion of the product display area. The luminaire is slidably and rotatably coupled to the case at a single point.

20 Claims, 5 Drawing Sheets

(51) Int. Cl.
*F21Y 103/10* (2016.01)
*F21Y 115/10* (2016.01)

(56) References Cited

U.S. PATENT DOCUMENTS

| | | | | |
|---|---|---|---|---|
| 6,364,273 | B1 | 4/2002 | Otema | |
| D470,262 | S | 2/2003 | Yiu | |
| 7,207,696 | B1 | 4/2007 | Lin | |
| 7,712,926 | B2 | 5/2010 | Matheson | |
| 7,837,352 | B2 | 11/2010 | Graybill et al. | |
| 8,240,894 | B2 | 8/2012 | Sanroma et al. | |
| 8,506,109 | B2 | 8/2013 | Stukenberg et al. | |
| 2008/0151535 | A1 | 6/2008 | de Castris | |
| 2008/0217500 | A1 | 9/2008 | Wronski | |
| 2008/0304252 | A1* | 12/2008 | Shibusawa | A47F 3/001 362/125 |
| 2010/0085757 | A1* | 4/2010 | Barkdoll | A47F 11/10 362/282 |
| 2010/0195317 | A1* | 8/2010 | Oketani | A47F 3/001 362/125 |
| 2011/0051401 | A1* | 3/2011 | Bauer | F21S 4/28 362/125 |
| 2011/0128740 | A1* | 6/2011 | Hartmann, Jr. | F21V 14/02 362/287 |
| 2012/0134144 | A1* | 5/2012 | Grassia | F21V 21/35 362/184 |

FOREIGN PATENT DOCUMENTS

| | | |
|---|---|---|
| JP | 2005116197 | 4/2005 |
| KR | 1020070085014 | 8/2007 |

OTHER PUBLICATIONS

Written Opinion from the International Searching Authority for Application No. PCT/2015/016015 dated May 22, 2015 (10 pages).
Office Action from the Canadian Patent Office for Application No. 2,939,105 dated Jul. 26, 2017 (3 pages).

* cited by examiner

ADJUSTABLE LIGHT MECHANISM FOR A MERCHANDISER

CROSS-REFERENCE TO RELATED APPLICATIONS

This application claims priority to U.S. Provisional Application No. 61/940,230, filed on Feb. 14, 2014, the entire contents of which are incorporated herein by reference.

BACKGROUND

The present invention relates to a light mechanism, and more particularly to an adjustable light mechanism for use in a refrigerated merchandiser.

Existing refrigerated merchandisers include a case that defines a product display area for supporting and displaying food product. Refrigerated merchandisers also typically include one or more luminaires that are attached to the case to provide illumination for the product display area.

SUMMARY

The invention provides a merchandiser including a case that defines a product display area and a luminaire that is coupled to the case to illuminate at least a portion of the product display area. The luminaire is slidably and rotatably coupled to the case at a single point.

In another construction, the invention provides a merchandiser including a case that defines a product display area and that includes a frame. The merchandiser also includes an attachment mechanism that is coupled the frame and slidable along a direction between a rear of the case and a front of the case, and a luminaire that is rotatably coupled to the attachment mechanism to illuminate at least a portion of the product display area. A position of the luminaire within the case is adjustable by translation of the attachment mechanism or rotation of the luminaire relative to the attachment mechanism.

In another construction, the invention provides a merchandiser including a case that defines a product display area and that includes a frame. The merchandiser also includes a luminaire that is coupled to the case to illuminate at least a portion of the product display area, and an adjustable attachment mechanism that is defined by a one-piece element coupled to the luminaire to slidably and rotatably attach the luminaire to the frame.

Other aspects of the invention will become apparent by consideration of the detailed description and accompanying drawings.

Before any constructions of the invention are explained in detail, it is to be understood that the invention is not limited in its application to the details of construction and the arrangement of components set forth in the following description or illustrated in the following drawings.

DETAILED DESCRIPTION

Figure 1:
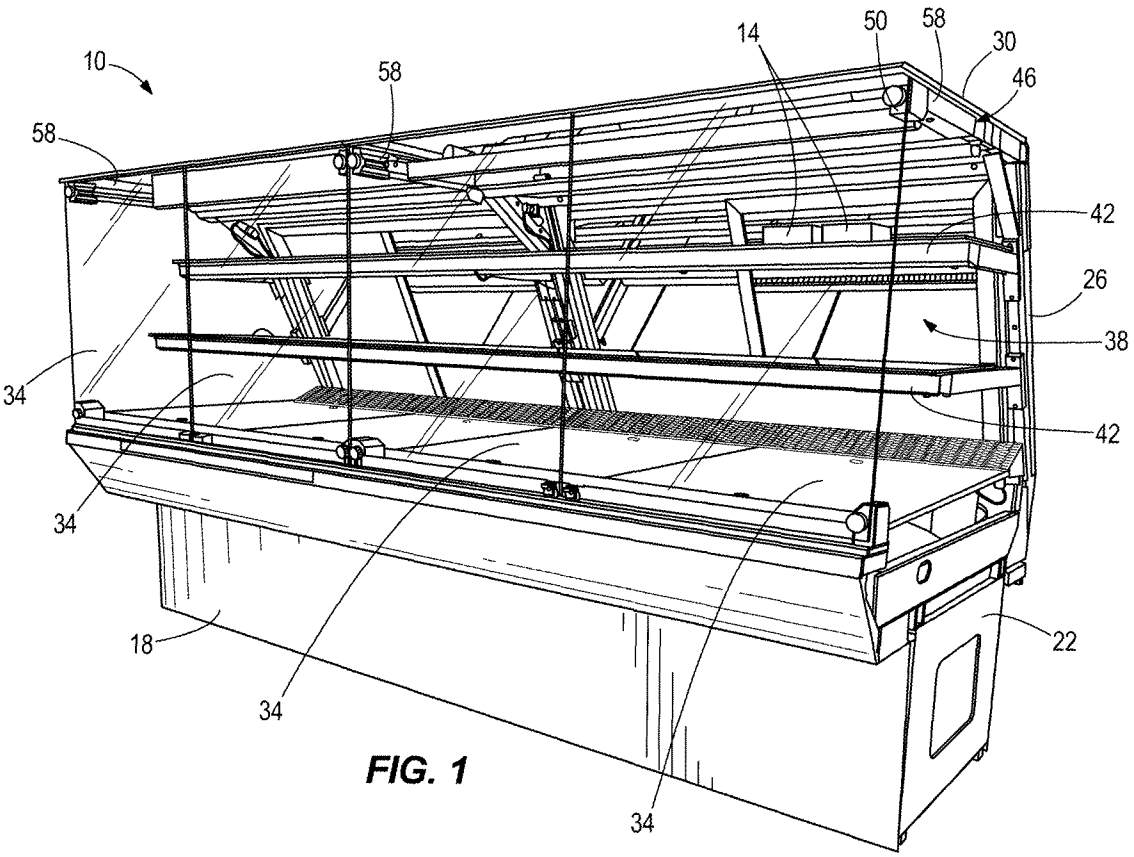
FIG. 1 is a perspective view of a merchandiser embodying the present invention and including a canopy.

FIG. 1 shows a refrigerated merchandiser 10 that may be located in a supermarket or a convenience store (not shown) for presenting fresh food, beverages, and other food product 14 (illustrated schematically) to consumers. The illustrated merchandiser 10 is an upright merchandiser, although other types of merchandisers (e.g., horizontal merchandisers, etc.) fall within the scope of the invention. The merchandiser 10 includes a case 18 that has a base 22, a rear wall 26, a canopy 30, and a plurality of front glass panels 34. The panels 34 are supported by the case 18. The area partially enclosed by the base 22, the rear wall 26, the canopy 30, and the panels 34 defines a product display area 38 that supports the food product 14 in the case 18. The food product 14 is displayed on racks or shelves 42 extending forwardly from the rear wall 26, and is accessible by consumers (e.g., when the glass panels 34 are moved or removed).

Figure 2:
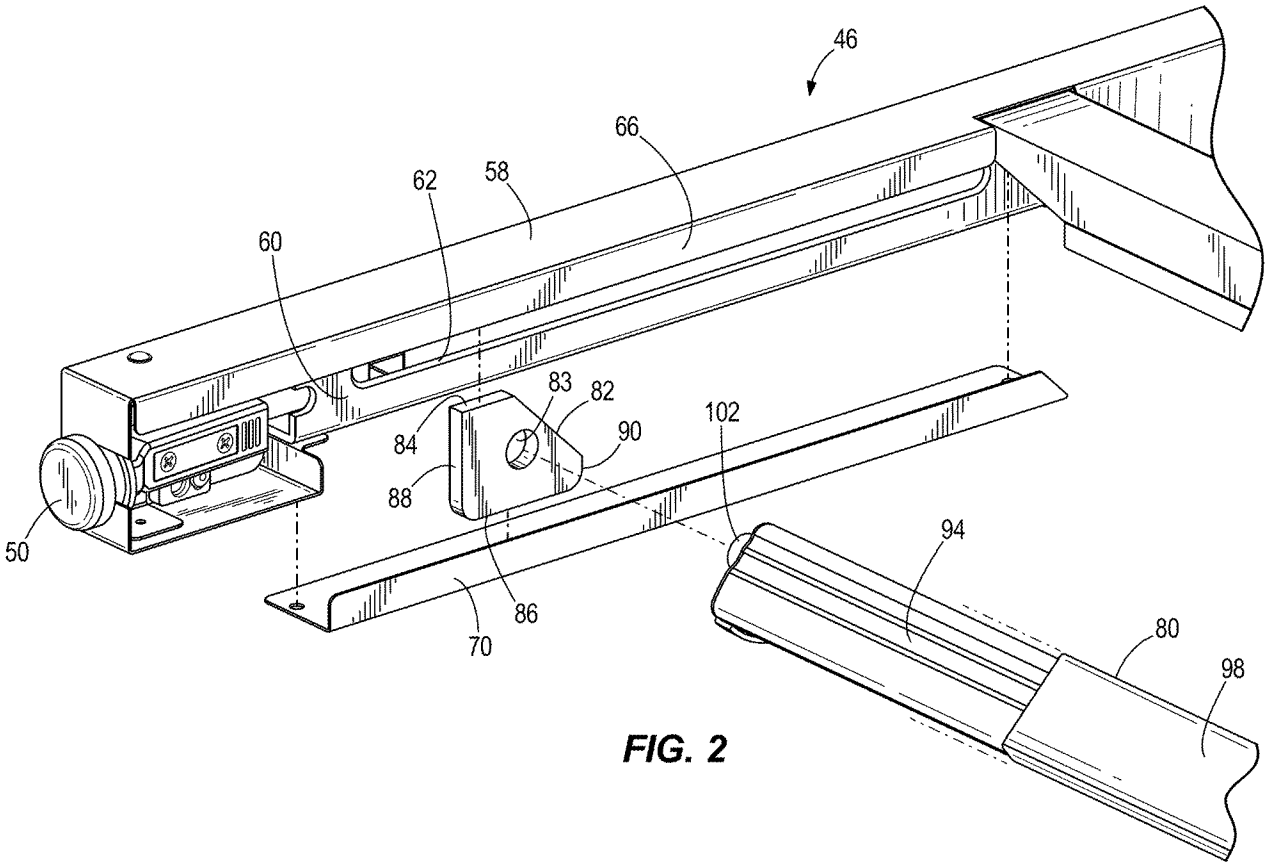
FIG. 2 is an exploded perspective view of a portion of the canopy.
Figure 3:
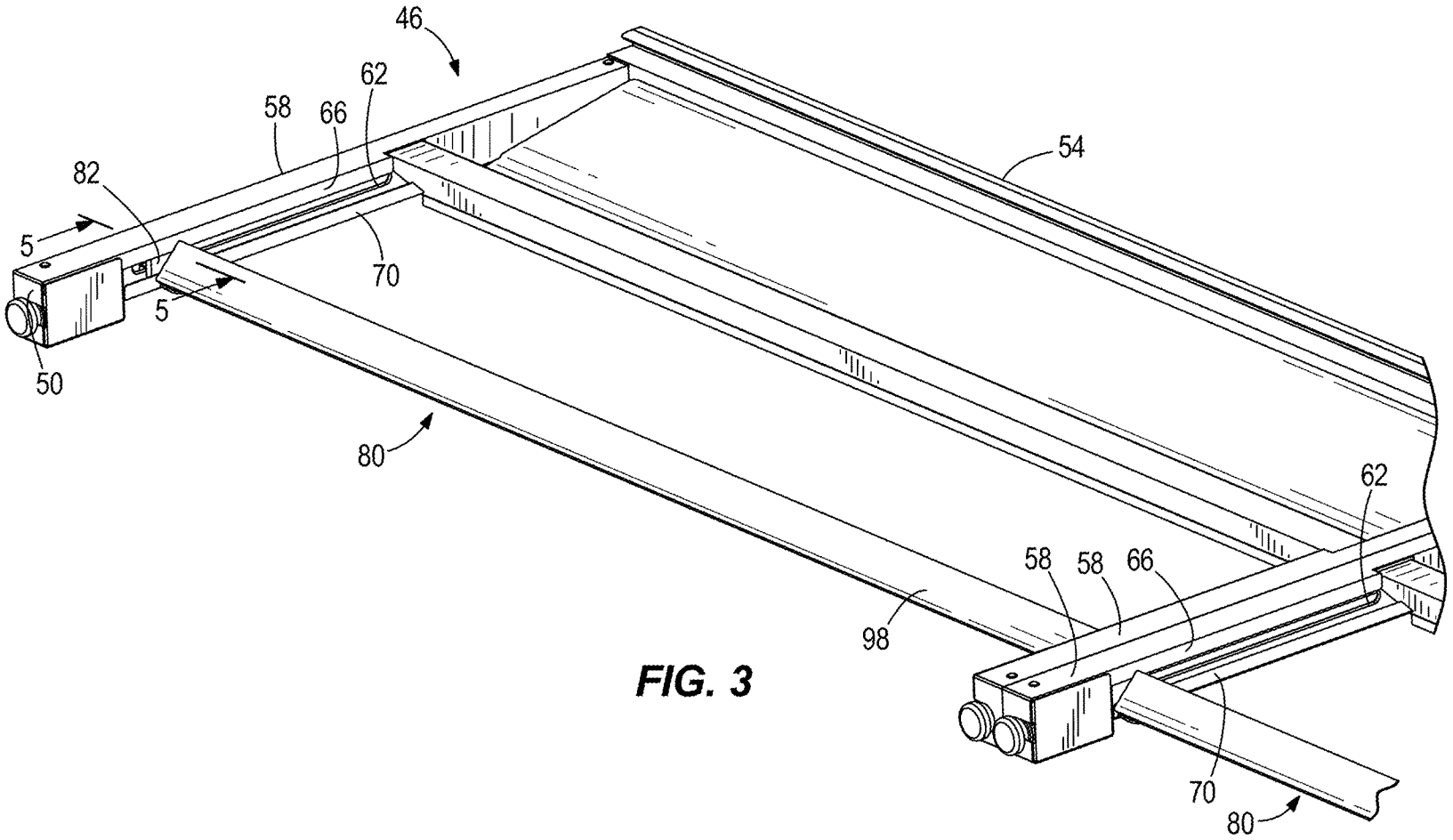
FIG. 3 is a perspective view of a portion of the canopy.

With reference to FIGS. 1-3, the canopy 30 includes a frame 46 that has a front edge 50, a rear edge 54 and frame members 58 that extend from the back edge 54 toward the front edges 50 in a direction perpendicular to the rear edge 54. As illustrated in FIG. 3, the frame includes four frame members 58, with two frame members 58 positioned on lateral sides of the canopy 30 and two frame members coupled to each other adjacent a lateral center of the canopy 30. It will be appreciated that the frame 46 can include different quantities and arrangements of frame members 58. Referring to FIGS. 2-5, each frame member 58 includes an interior-facing wall 60 that has an elongate opening 62 (e.g., a slot) extending longitudinally along the wall 60 (between the front and back edges 50, 54).

Figure 4:
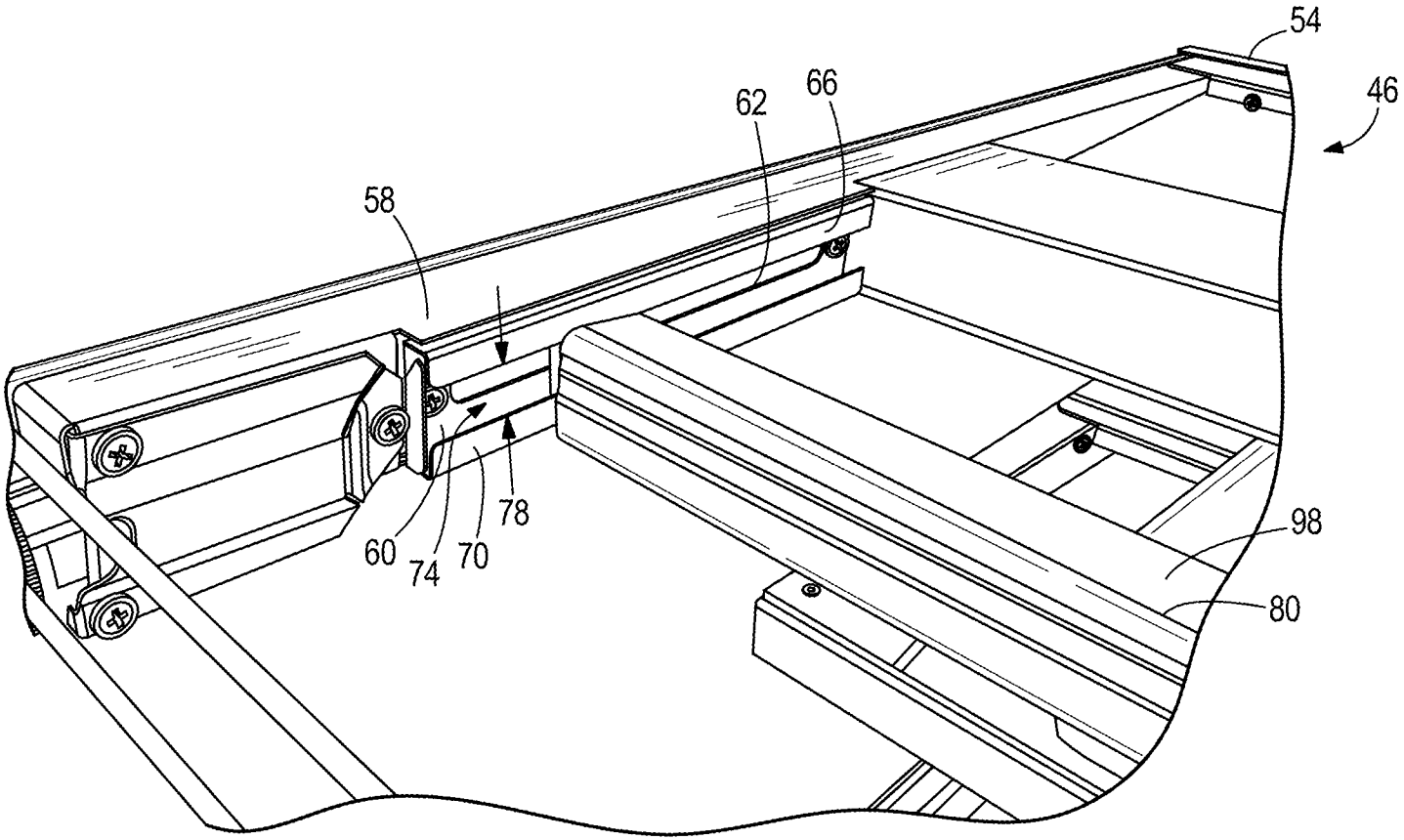
FIG. 4 is an enlarged perspective view of a portion of the canopy.
Figure 5:
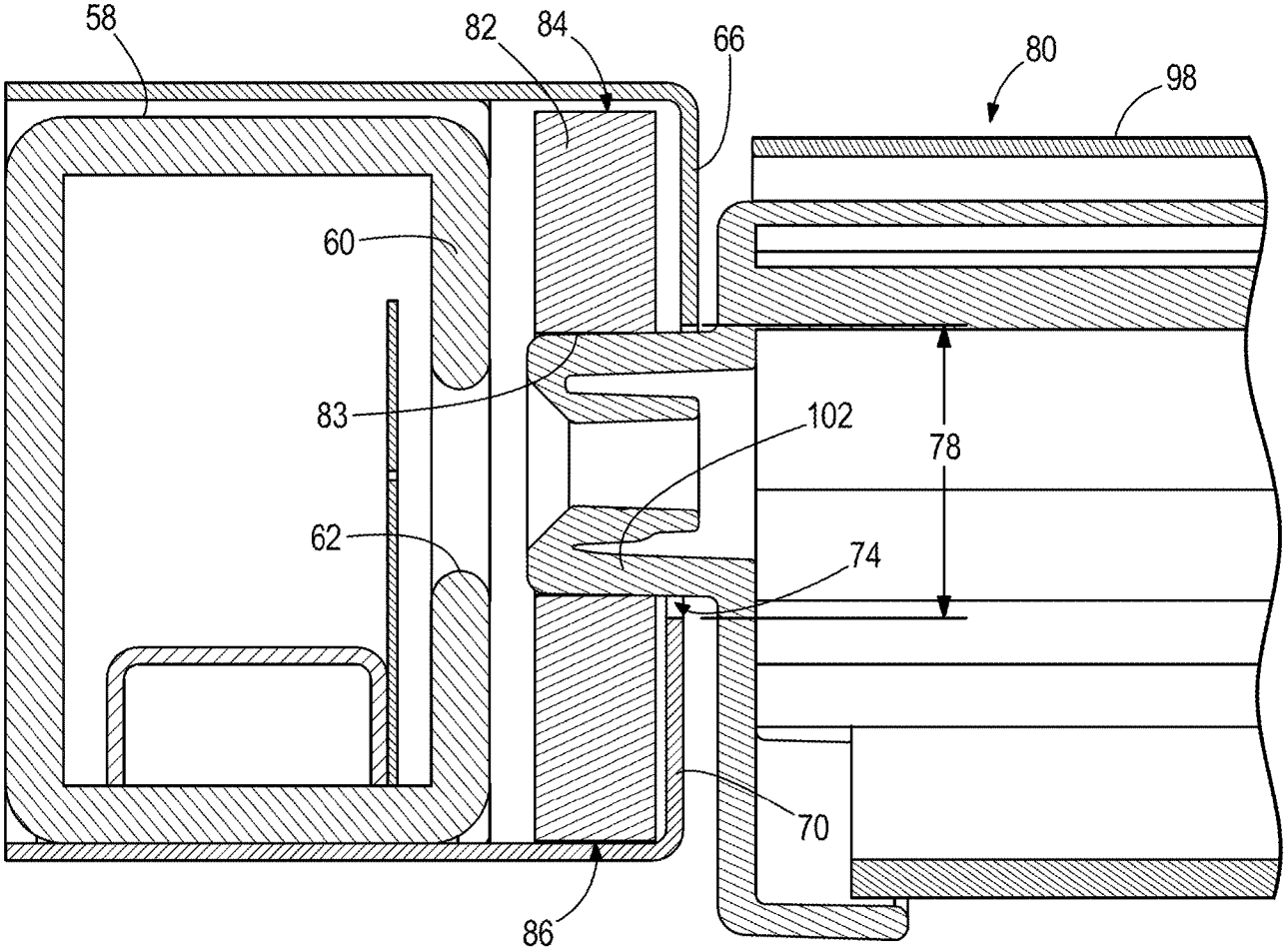
FIG. 5 is a cross-section view taken along lines 5-5 in FIG. 3.

With reference to FIGS. 2 and 3, the frame member 58 has a first flange 66 and a second flange 70 is coupled to the frame member 58 such that the flanges 66, 70 cooperatively define a channel 74 when the flange 70 is attached to the frame member 58. The flange 70 also encloses a bottom side of the frame member 58 (see FIG. 5). As illustrated in FIGS. 4 and 5, a gap 78 is defined between opposite edges of the flanges 66, 70 (the edges facing each other). The gap 78 communicates with the channel 74 (i.e. provides access to the channel 74) and is aligned with the opening 62.

With reference to FIGS. 2-5, the merchandiser 10 also includes light assemblies or luminaires 80 that are adjustably coupled to the case 18 by attachment elements or attachment mechanisms or sliders 82 (described as "attachment elements" for purposes of description). As illustrated in FIGS. 2 and 5, the illustrated attachment mechanism 82 is defined by a square-truncated body that has a central hole 83, an upper surface 84, a lower surface 86, a forward surface 88, and an angular, rearward-facing surface 90. The hole 83 can be a through hole or blind a recess. As shown in FIG. 5, the upper surface 84 is slidable along the interior of the first flange 66, and the lower surface 86 is slidable along the interior of the second flange 70.

FIGS. 3 and 5 illustrate that the attachment mechanism 82 is disposed within the channel 74 between the flanges 66, 70 and the wall 60. The attachment mechanisms 82 are movable within their respective channels 74 linearly along the channel 74 (i.e. in a direction along the frame member 58 between the front edge 50 and the rear edge 54. The height of the attachment mechanism 82 (the distance between upper and lower surfaces 84, 86) is larger than the gap 78 such that the attachment mechanism 82 is restrained or encapsulated by the flanges 66, 70 and held in the channel 74. The forward surface 88 cooperates with a forward portion of the frame member 58 to limit further forward movement of the attachment mechanism 82, and the rearward surface 90 cooperates with a rearward portion of the frame member 58 to limit further rearward movement of the attachment mechanism 82 when adjusting the linear position of the luminaire 80 relative to the frame 46. The truncated shape of the attachment mechanism 82 reduces the surface area of the upper surface 84 to facilitate movement of the mechanism 82 within the channel 74.

With reference to FIG. 2, each luminaire 80 includes one or more light sources 94 (e.g., fluorescent, LED, etc.) that emit light to illuminate the product display area 38. Each luminaire 80 has a translucent or transparent cover 98 and a light source 110. The luminaire 80 is positioned between two frame members 58 and includes a protrusion or projection 102 that is shaped to fit into the hole 83 to attach the luminaire 80 to the case 18. The projection 102 is cylindrical and matches the cross-sectional shape of the hole 83 so that the luminaire 80 can rotate or pivot relative to the frame 46. As will be appreciated, the hole 83 and/or the projection 102 can be lubricated or can include one or more bearings to facilitate movement of the luminaire 80 relative to the attachment mechanism 82. In another example, the projection 102 can be fixed within the hole 83 and the luminaire 80 can be rotatably coupled to the projection 102 (e.g., via bearings). In addition, it will be appreciated that the hole-projection attachment can be reversed such that the hole or recess is defined on the ends of the luminaire 80 and the projection is defined by the attachment mechanism 82.

The attachment mechanism 82 is sandwiched between the first and second flanges 66, 70 during assembly of the second flange 70 to the frame 46, and the luminaire 80 is attached to the attachment mechanism 82 by inserting the projection 102 into the hole 83. For example, the luminaire 80 can be attached to the attachment mechanism 82 and this sub-assembly can be coupled to the frame 46 within the channel 74. In one variation of the assembly, the luminaire 80 can be attached to the attachment mechanism 82 after the attachment mechanism 82 is coupled to the frame 46 within the channel 74.

When the attachment mechanism 82 is positioned within the channel 74, the hole 83 is generally aligned with the elongate opening 62 and the gap 78 to form a passage into which the projection 102 at least partially extends (the amount of extension depends on the length of the projection 102). As illustrated in FIG. 5, linear translation of the luminaire 80, via sliding the attachment mechanism 82 within the channel 74, is limited by the length of the channel 74. In examples where the projection 102 extends into the elongate opening 62, the sliding distance is limited by whichever of the elongate opening 62 or the channel 74 that defines a forward or rearward stop for the attachment mechanism 82 or the projection 102.

The illustrated attachment mechanism 82 is a single or one-piece element (e.g., a rigid element) that permits rotation and translation of the luminaire 80 relative to the frame 46. The connection between the projection 102 and the attachment mechanism 82 permits at least 100 degrees of rotational movement (e.g., up to 360 degrees of rotation) of the luminaire 80 from a nominal position (e.g., with the primary light axis defined by the light source(s) oriented along a vertical plane) relative to the frame member 58. the connection also provides sliding engagement or translational movement of the attachment mechanism 82 relative to the frame member 58 to permit linear adjustment of the position of the luminaire 80 (to accomplish different forward and rearward positions). For example, the luminaire 80 can be translationally repositioned approximately 4-12 inches fore and aft relative to a position of the luminaire adjacent a center of the channel 74.

The translational and rotational attachment between the frame 46 and the luminaires 80 allows adjustment of the orientation luminaire 80 so that light emanating from the luminaire 80 can project onto a desired area (e.g., product in the product display area 38, a region of the display area 38, etc.) within the case 18. No tools are necessary to facilitate adjustment of the position of the luminaire 80. The luminaires 80 also can be easily removed for cleaning. While the invention has been described and illustrated in detail with regard to the luminaire 80 being slidably and pivotably coupled to a canopy frame member 58, it will be appreciated that the luminaire 80 can be coupled to other case structure (e.g., shelves 42) of the merchandiser 10

Various features and advantages of the invention are set forth in the following claims.

The invention claimed is:

1. A merchandiser comprising:

a case defining a product display area; and a luminaire coupled to the case and including a light source configured to illuminate at least a portion of the product display area, wherein the luminaire is slidably and rotatably coupled to the case at a single point, and wherein the luminaire is slidably and rotatably adjustable to different positions relative to the case while remaining attached to the case.

2. The merchandiser of claim 1, wherein the case includes a canopy having frame members, and wherein the luminaire is slidably and rotatably coupled to the frame members.

3. The merchandiser of claim 2, wherein each of the frame members defines a channel, and wherein the luminaire is coupled to the frame members within each channel.

4. The merchandiser of claim 2, further comprising an attachment mechanism disposed within each channel, and wherein ends of the luminaire are coupled to the respective attachment mechanisms.

5. The merchandiser of claim 4, wherein the attachment mechanism is slidable along the channel and the luminaire is rotatable relative to the attachment mechanism.

6. The merchandiser of claim 5, wherein the attachment mechanism includes a hole and the luminaire includes a projection engaged with the attachment mechanism within the hole.

7. The merchandiser of claim 1, wherein the luminaire includes light emitting diodes.

8. A merchandiser comprising:

a case defining a product display area and including a frame;

an attachment mechanism coupled to the frame and slidable along a direction between a rear of the case and a front of the case; and a luminaire rotatably coupled to the attachment mechanism and including a light source configured to illuminate at least a portion of the product display area, wherein a position of the luminaire within the case is adjustable by translation of the attachment mechanism or rotation of the luminaire relative to the attachment mechanism, and wherein the luminaire is slidably and rotatably adjustable to different positions relative to the case while remaining attached to the case.

9. The merchandiser of claim 8, wherein the luminaire includes a first end and a second end, wherein the attachment mechanism is a first attachment mechanism that is coupled to the first end, and wherein the merchandiser further comprises a second attachment mechanism that is coupled to the second end.

10. The merchandiser of claim 8, wherein a portion of the frame defines a support of a canopy or a shelf, and wherein the attachment mechanism is encapsulated by a frame portion.

11. The merchandiser of claim 10, wherein the frame portion has a channel and the attachment mechanism is disposed in and movable within the channel.

12. The merchandiser of claim 11, wherein the luminaire has an end extending through a side of the frame portion into the channel.

13. The merchandiser of claim 12, wherein the attachment mechanism has one of a recess or a projection and the luminaire has the other of the recess or the projection, and wherein the projection is rotatable within the recess.

14. The merchandiser of claim 8, wherein the luminaire is rotatable at least 100 degrees relative to a nominal position of the luminaire in which a primary light axis of the luminaire is oriented along a vertical plane.

15. A merchandiser comprising:

a case defining a product display area and having a frame;

a luminaire coupled to the case and including a light source configured to illuminate at least a portion of the product display area; and an adjustable attachment mechanism defined by a one-piece element coupled to the luminaire to slidably and rotatably attach the luminaire to the frame, and wherein the luminaire is slidably and rotatably adjustable to different positions relative to the case via the attachment mechanism while remaining attached to the case.

16. The merchandiser of claim 15, wherein the frame has a frame member defining a channel, and wherein the attachment mechanism is disposed in and translational within the channel.

17. The merchandiser of claim 16, wherein an end of the luminaire is rotatably coupled to the attachment mechanism.

18. The merchandiser of claim 17, wherein the attachment mechanism includes a hole and the luminaire includes a projection engaged with the attachment mechanism within the hole.

19. The merchandiser of claim 15, wherein the luminaire includes a first end and a second end, wherein the attachment mechanism is a first attachment mechanism that is coupled to the first end, and wherein the merchandiser further comprises a second attachment mechanism that is coupled to the second end.

20. The merchandiser of claim 15, wherein a portion of the frame defines a support of a canopy or a shelf, and wherein the attachment mechanism is encapsulated by a frame portion.

* * * * *